United States Patent [19]

Morin

[11] Patent Number: 4,788,084

[45] Date of Patent: Nov. 29, 1988

[54] PROCESS FOR SIZING METAL OXIDE COATED NON-METALLIC OR SEMIMETALLIC FILAMENTS

[75] Inventor: Louis G. Morin, Tarrytown, N.Y.

[73] Assignee: American Cyanamid Co., Stamford, Conn.

[21] Appl. No.: 507,602

[22] Filed: Jun. 24, 1983

[51] Int. Cl.[4] ..... B05D 3/04; B05D 3/10

[52] U.S. Cl. ..... 427/343; 427/377; 427/385.5; 427/387; 427/407.1; 427/419.2; 427/434.6

[58] Field of Search ..... 427/315, 318, 385.5, 427/327, 343, 387, 388.1, 377, 388.2, 388.4, 394, 399, 389.9, 444, 384, 409, 404, 419.2, 419.5, 434.6, 434.7, 435, 407.1; 428/375, 379, 380, 383, 391

[56] References Cited

U.S. PATENT DOCUMENTS

| | | | |
|---|---|---|---|
| 3,088,847 | 5/1963 | Pines | 427/388.1 |
| 3,191,286 | 6/1965 | Armstrong et al. | 427/327 |
| 3,782,999 | 1/1974 | Marzocchi | 427/404 |
| 4,118,540 | 10/1978 | Amort et al. | 427/388.4 |
| 4,364,731 | 12/1982 | Norling et al. | 427/419.2 |

FOREIGN PATENT DOCUMENTS

| | | | |
|---|---|---|---|
| 2350360 | 5/1974 | Fed. Rep. of Germany | 427/409 |
| 1266017 | 5/1961 | France | 427/409 |
| 38-4470 | 4/1963 | Japan | 427/409 |
| 396453 | 1/1974 | U.S.S.R. | 427/315 |

*Primary Examiner*—Sadie L. Childs

*Attorney, Agent, or Firm*—Michael J. Kelly; Steven H. Flynn

[57] ABSTRACT

Filaments, yarns or tows of metal coated nonmetallic and semimetallic materials, e.g., nickel coated graphite, are sized, e.g., with poly(vinyl acetate), and/or oxidized, e.g., in steam at an elevated temperature to produce a surface of nickel oxide, and the resulting products mix more readily into plastic materials and have enhanced processability when knitted and woven.

14 Claims, 1 Drawing Sheet

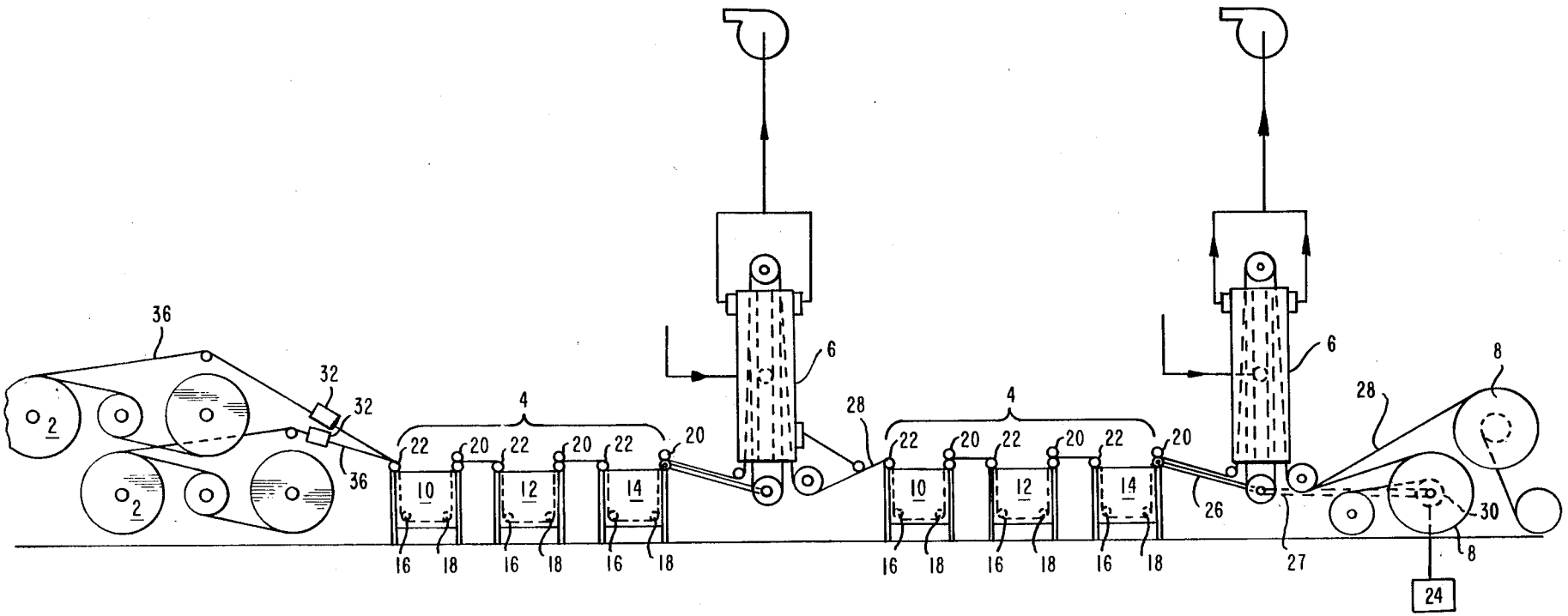
8
30
8
24
28
6
27
26
20
18
14
16
22
20
18
12
16
22
4
20
18
10
16
22
28
6
20
18
14
16
22
20
18
12
16
22
4
20
18
10
16
22
32
32
36
36
2
2

PROCESS FOR SIZING METAL OXIDE COATED NON-METALLIC OR SEMIMETALLIC FILAMENTS

FIELD OF THE INVENTION

This invention relates generally to the surface treatment of metallic filaments, and particularly metal-plated semimetallic and polymeric fibers. More particularly, the invention relates to sizing and/or oxidizing metallic filaments, e.g., metal-plated carbon fibers to afford properties which enhance the fibers as blending materials with plastics and as weaving materials.

DESCRIPTION OF THE PRIOR ART

It has been known for some time that metallic filaments, e.g., filaments of metals, and metal coated nonmetals and semimetals such as carbon, boron, silicon carbide, polyesters, polyamides, and the like in the form of filaments, fibers, mats, cloths and chopped strands are extremely desirable and beneficial, for example, in reinforcing organic polymeric materials.

Typically, the metallic filaments are blended with polymeric materials to form articles where low weight-high strength applications are desirable. Aircraft, automobile, office equipment and sporting goods are among the many applications for reinforcement by high strength fibers.

In addition, weaving or knitting are also used to form the filaments into cloth or fabric-like articles, particularly when strength or substance is to be provided in a matrix comprised of the metallic filaments and a polymeric material such as an epoxy, nylon, a polyester, a phenolic, or a polyolefin such as polypropylene.

Recently, it has been recognized that the properties of the high strength nonmetal or semimetallic filaments such as carbon, or polymeric filaments such as aramid filaments can be enhanced by deposition of metal such as nickel and silver in thin surface coatings These metallic filaments have the same application as uncoated carbon or polymer filaments but enjoy improved properties such as increased strength in plastic matrixes and electrical conductivity. This makes them especially useful, for example as components in aircraft where lightning strike resistance is essential.

Several processes now exist for the production of metallic filaments e.g., vacuum deposition, ion discharge coating, electroless metal deposition and electrodeposition.

Regardless of the process by which the filaments are obtained or coated with metal, the resulting product is somewhat characterized by an inability to easily blend with plastics to form organic structures or to be woven into fabric-like articles. The difficulty with blending such metallic filaments with organic materials is due to the fineness of the material, and a tendency for fuzz to develop. For example, a difficulty that attends weaving of metal-plated carbon filaments is due to the abrasiveness of the surface and presence of random tow material extending from the fiber surface.

SUMMARY OF THE INVENTION

It is an object of the present invention to provide a process by which metallic filaments, especially metal-coated filaments, can be provided with the properties helpful to facilitate blending with organic plastic materials, and for the provision of properties desirable and necessary for weaving the metal-coated fibers into fabric or mat-like articles.

It is a further object of the invention to provide metallic filaments with lubricity.

It is another and further object of the invention to provide metal-coated high strength fibers with a minimum of random fibrils extending outwardly from the basic fiber.

It is yet another object of the invention to provide metallized filaments with a metal oxide surface layer.

It is another object of the invention to provide composites, e.g., laminates, comprising metallized filaments having a surface treated by sizing and/or oxidizing and an organic polymeric matrix.

The process of the present invention is characterized by delivery of metallic filaments to a medium comprising a coupling and sizing agent, e.g., aminosilane, alone, or in further combination with a medium comprising a bulking and polymeric sizing agent, e.g., polyvinyl acetate. Further processing of the material is also contemplated by passage of the material through dispersants, fluxes, and/or an external lubricant and sizing agent, e.g., polyethylene emulsion, combined with, or after discharge from the bulking and polymeric sizing bath. This entire process is conveniently referred to as sizing. During an intermediate step or after the sizing steps are complete, the fibers can be heated to dry and set the sizing material on the fibers. Among its features, the present invention also contemplates a process to surface oxidize metallic filaments under controlled conditions, alone, or in further combination with sizing.

The apparatus provided to facilitate the process to size the metallic filaments is comprised of one or more tanks, each of which contains idler rollers disposed near the bottom and driven contact rollers above. The tank or tanks have the capacity to maintain emulsions or solutions of sizing material such as aminosilane and/or polyvinyl acetate. Guide rollers are also provided at the entry of each tank. Means in the form of heating ovens are provided to dry and set the material after each sizing step or steps, and a driven capstan roller is provided to afford the principal motive force for the passage of the metal-coated filaments through the bath. Surface oxidation is carried out conveniently by way of illustration, in a medium, such as a steam bath, during which the metal surface reacts with air or an obvious equivalent.

DESCRIPTION OF THE DRAWING

The invention will be more readily understood by reference to the drawing, which is a cross-sectional elevational schematic view of the process and apparatus to size and/or surface-oxidize metallic filaments, e.g., metal-coated high strength fibers.

DESCRIPTION OF THE PREFERRED EMBODIMENT

The process and apparatus of the present invention are directed to providing the surface of metallic filaments and similar articles with properties desirable for weaving and blending the product. The process and apparatus, in essence, provide metallized filaments, e.g., fibers, with a sizing material or materials that impart various properties to them, such as lubricity and bulk, and enhanched compatibility with plastics, and improved resistance to moisture, e.g., when mixed with polymers.

For convenience, the following discussion will deal with metal-coated fibers, although it is to be understood that metallic filaments can be processed also.

As best seen, in the drawing, the apparatus consists of pay-out reels 2, sizing sections 4, heating assemblies 6, and a capstan 8. As will be explained later, section 4 can comprise a single tank and one or more heating assemblies 6 can be used. Furthermore, means 32 for providing an oxidized surface, such as low pressure steam boxes, can also be included.

As seen in the drawing, in one embodiment the sizing section 4 is further comprised of a first tank 10, a second tank 12, and a third tank 14, all of which are adapted to contain sizing solutions and to facilitate the continuous flow of metal-coated fibers therethrough. Each tank 10, 12 and 14 is provided with idler rollers 16 and 18 disposed near the bottom of the tank. Rollers 16 and 18 are cylindrical and guide roller 22 is flat bottom, to facilitate tow spread and uniform sizing.

Each tank is arranged with driven contact rollers 20 and 22 located above the tank in general alignment with the idler rollers 16 and 18. Guide rollers 22 are also located at the entry of each tank.

The heating section 6 consists of means for heating the sized metal-coated fiber to dry and set the sizing solutions or emulsions to the metal-coated carbon fiber. As has been indicated, each tank can be followed by an independent heating section 6.

The drive for the assembly is provided by a motor 24, which transmits drive directly to the capstan 8 and a chain gear assembly comprised of chains 26 and 27, from which the power is transmitted from the capstan gear 30 to the contact roller 20.

In one way of carrying out the present invention, a plurality of metal-coated fibers 36, preferably nickel-coated carbon or nickel-coated aramid, e.g., Du Pont KEVLAR 49, fibers is threaded, from the pay-out reels 2 through optional steam boxes 32, over the guide rollers 22 and around the contact rollers 20 under the idler rollers 16 and 18 through one or more of the sizing tanks in one or more sizing sections 4 and preferably through one or more heating sections 6 to the capstan 8. The capstan is then driven by the motor 24, and the process of sizing begins. The metal-coated surface-oxidized fibers 36 first preferably pass through tank 10, which is filled with a coupling/sizing agent such as an aminosilane solution. After passage through the tank 10, the metal-coated fiber is essentially provided with a coupling/sizing surface that has been coupled to the metal oxide surface of the coated fiber. Thereafter, the fiber 36 is delivered to the tank 12, which contains a bulking/sizing agent such as a polyvinyl acetate solution. The polyvinyl acetate solution provides, in combination with the coupling/sizing, e.g., aminosilane coating, a bulk density for the metal-coated fibers. Alternatively, both sizing agents can be combined in a single tank. Thereafter, the fibers 36 are delivered to the tank 14, in which a sizing/lubricating agent, e.g., polyethylene solution or emulsion is provided to afford lubricity for the fibers. Alternatively, this can be combined in a single tank with the sizing/coupling and/or sizing/bulk density agent.

The sized fibers 28 are then delivered to the oven section 6, wherein drying and setting occur and the heated dried fibers 28 are forwarded to a second sizing section 4 and drying section 6 and, finally wound on the capstan roll 8. Although dual stages are shown, for flexibility, depending on the circumstances, only a single stage may be used.

With respect to the coupling/sizing agent component, this will typically comprise a surface-reactive coupling agent. Typically, it will be a silane or a titanate. Silanes have the general formula $Y\text{-}R\text{-}Si\text{-}X_3$ wherein X represents a hydrolyzable group, e.g., alkoxy; Y is a functional organic group such as methacryloxy, epoxy, etc., and R typically is a small aliphatic linkage, $-(CH_2)_n-$, that serves to attach the functional organic roup to silicon (Si) in a stable position. Illustratively, available silanes are: vinyltriethoxysilane, vinyltris(beta-methoxyethoxy) silane, gammamethacryloxypropyltrimethoxy silane, beta-(3,4-epoxycyclohexyl) ethyltrimethoxysilane, gamma-glycidoxypropyltrimethoxysilane, gamma-aminopropyltriethoxysilane, n-beta-(aminoethyl) gamma-aminopropyltrimethoxysilane, gamma-uriedopropyltriethoxysilane, gamma-chloropropyltrimethoxysilane, gamma-mercaptopropyltrimethoxysilane, and the like. The aminosilanes are preferred. All can be used in conventional amounts and in the usual media, as supplied, or diluted with water or an organic solvent, or even as a dry concentrate, e.g., in a fluidized bed. Typical titanates are isopropyltri(dioctylpyrophosphate) titanate, titanium di(-dioctylphosphate) oxyacetate and tetraoctyloxyltitanium di(dilaurylphosphite).

In practice, it has been found that aminosilane solutions of between 0.1 and 2.5 parts of gamma-aminopropyltriethoxysilane such as Dow-Corning Z-6020, or gamma-glycidoxypropyltrimethoxysilane such as Dow-Corning Z-6040, per 100 parts of water adjusted to a pH of between 3.5 and 8, 3. g., by acetic acid, are particularly suitable for coupling aminosilanes to nickel- or silver-coated carbon or aramid fibers. Practice has taught that the residence time of the fiber in the solution should be at least sufficient to generate a surface having coupled sizing. This will usualy be about 0.5 seconds, but the time can be longer, e.g. at least about 5 seconds, depending on downstream residence time requirements.

With respect to the bulking/sizing agent, this can be usually an organic polymeric material conventional for this purpose. Preferably, it will be a vinyl polymer or a cellulosic dissolved in water or an organic solvent, or emulsified in water. Among the polymers suitable for use are starches, cellulosic ethers, esters and carboxylates. In addition, pllyvinyl esters such as polyvinyl acetate and copolymers such as ethylene/vinyl acetate can be used, as well as polyvinyl alcohol and dispersants, such as polyvinyl pyrrolidone. It is preferred to use polyvinyl acetate. All are used in amounts established and well known to be suitable for sizing purposes.

Practice has also taught that a polyvinyl acetate solution of about 20 parts of carboxylated polyvinyl acetate latex (Borden's Polyco 2142, 50% solids) per 100 parts of water provides a particularly suitable solution for contributing bulk density to the metal-plated fibers. The residence time for the fiber in the polyvinyl acetate medium should be at least sufficient to generate a sized surface, preferably at least about 5.0 seconds.

Lubricity is imparted by slip agents or lubricants comprising organic materials conventionally used.

Preferably, molecular films will be formed between the sized fibers and surfaces against which they are moved, e.g., virgin plastic pellets. Such a characteristic reduces tendency to hang-up and abrade. Illustrative lubricants are fatty alcohols, fatty acid esters, glycerol partial esters, polyesters, fatty acid amides, e.g., oleamide, metal soaps, fatty acids, e.g., stearic acid and polyolefins, especially polyethylenes, which are preferred. These can be used in the form of solutions and emulsions.

A polyethylene emulsion of 10 parts of polyethylene (Bercen, Inc.'s Bersize S-200, 50% solids) in 100 parts by weight of water provides a particularly desirable solution to afford lubricity to the fibers. Fiber residence times sufficient to generate a lubricated surface are used. Time of at least about 5 seconds in the polyethylene medium has been found to be desirable.

The method for producing an oxidized surface on the metal coated filament comprises in general exposing the outer surface to an oxidizing medium. The metal surface, of course, will be one capable of oxidation. Chemical or atmospheric techniques, and the like, can be employed, e.g., with nickel, tin, copper, brass, and the like, and the use of heat is recommended because the rate of production of the surface oxide coating is enhanced. It is especially convenient to use air or an oxygen-containing gas as the medium for oxidation and to use steam as a source of heat. Sufficient time is provided to produce the metal oxide coating, preferably a uniform, thin, coating. In a continuous process, using steam and air, only a fraction of a second is preferred, e.g., about 0.5 seconds, although less or more time can be allowed. For best results, the filaments are dried prior to being sized.

The sized and/or oxidized metallic filaments produced in the process have been used as chopped material to mix with and blend with plastics, e.g., at about 5–50% by weight in nylon, polyesters, polycarbonates, polyolefins, polyurethanes, polystyrenes, polyepoxides, and the like, to provide composites of the fibers and a matrix of the plastic. If the filaments are woven, knitted or laid up onto the mats, laminates can be obtained. It has been found that sized metal-coated carbon fibers can more readily be blended with plastic without a great deal of difficulty due to the added bulk density of the sized chopped material. Testing has shown that composites made from 60 parts of silane sized fibers according to this invention with 40 parts, by weight, of epoxy resin and curing, are about 30% better in terms of short beam shear strength at room temperature, and at elevated moist temperature, than those made with unsized fibers.

The fibers sized and/or surface oxidized in accordance with the process of the present invention also have been woven into fabric patterns. It has been observed that the fuzz typically extending randomly from the metal-coated fiber do not interfere with the weaving after the sizing has occurred. Further, the woven material can be formed into a fabric pattern very easily by virtue of the lubricity that inheres in the sized material. Conversely, sized nickel-coated carbon, graphite, or other high strength fiber, has been found to have excellent lubricity and lacks abrasiveness, facilitating weaving. Also sized fibers avoid random fibers extending from the fibers which can cause an accumulation of fuzzy materials which interfere considerably with any weaving pattern by depositing on guides in the machines, etc.

Further, the sizing materials can act as water displacement agents which reduce the tendency of composites made from the coated fibers to delaminate after being put into a plastic matrix, and exposed to moisture.

Practice has taught that a carbon fiber coated with nickel and treated with steam, e.g., distilled water steam, will provide a nickel oxide surface, dense and adherent of 15–50 angstroms thick, particularly compatible with aminosilane, and this is very useful to produce composites with polymers having desirable characteristics.

The invention may be varied in ways which will suggest themselves to those skilled in this art in light of the above, detailed description. For example, instead of a polyvinyl acetate sizing/bulking agent, a nylon sizing-/bulking agent can be used. All such obvious variations are within the full intended scope of the appended claims.

What is claimed is:

1. A process for sizing metal coated nonmetallic or semimetallic filaments said process comprising:

(a) providing said filaments with a metal oxide surface;

(b) passing said filaments through a sizing medium; and (c) heating said filaments to dry and set the sizing material on the filaments.

2. A process as in claim 1 further comprising the step of passing said filaments through a size/bulk density medium after passage through the sizing medium.

3. A process as in claim 1 further comprising the step of passing said filaments through a lubricity sizing additive medium after passage through the sizing/bulk density medium.

4. A process as in claim 1 wherein said filament has a nickel oxide surface or a silver oxide surface.

5. A process as in claim 1 wherein the medium is an aminosilane sizing/coupling medium.

6. A process as in claim 5 wherein the aminosilane medium is a water base solution having between 0.1 and 2.5 percent by weight aminosilane adjusted to a pH between 3.5 and 8, and the residence time of the filament in the aminosilane medium is at least about 0.5 seconds.

7. A process as in claim 2 wherein the sizing/bulk density medium is polyvinyl acetage or nylon.

8. A process as in claim 7 wherein the polyvinyl acetate is a water base emulsion of about 15 to 40 percent by volume polyvinyl acetate and the residence time of the filament in the emulsion is at least about 5 seconds.

9. A process as in claim 3 wherein the lubricity sizing additive medium is a polyethylene emulsion.

10. A process as in claim 9 wherein the polyethylene solution is a water base emulsion comprised of 10 percent by weight of polyethylene, and the residence time of the filament in the polyethylene emulsion is at least about 5 seconds.

11. A process for oxidizing metal coated nometallic or semimetallic filaments comprising passing the filaments through an oxidizing medium at an elevated temperature until a substantially uniform surface oxide coating is produced on the filaments.

12. A process as in claim 1 wherein the oxidizing medium is steam.

13. A process for oxidizing metal coated nonmetallic or semimetallic filaments comprising passing the metallic filaments through an oxidizing medium at an elevated temperature until a substantially uniform surface oxide coating of nickel oxide is produced on the filaments.

14. A process for sizing metal coated nonmetallic or semimetallic filaments said process comprising:

(a) passing said filaments through an oxidizing medium at an elevated temperature until a metallic surface oxide coating is produced on the filaments;

(b) passing said fliaments coated with a metallic surface oxide through a sizing medium, and (c) heating said filaments to dry and set the sizing material on the filaments.

* * * * *